United States Patent [19]

Long

[11] Patent Number: 4,934,297

[45] Date of Patent: Jun. 19, 1990

[54] SAILBOARD HARNESS SPREADER BAR

[76] Inventor: Ian Long, P.O. Box 8603, Aspen, Colo. 81612

[21] Appl. No.: 295,262

[22] Filed: Jan. 9, 1989

[51] Int. Cl.[5] ..... B63B 35/82

[52] U.S. Cl. ..... 114/39.2; 182/3

[58] Field of Search ..... 114/39.2; 182/3

[56] References Cited

U.S. PATENT DOCUMENTS 4,588,044 5/1986 Mader ..... 114/39.2 X

FOREIGN PATENT DOCUMENTS 3215328 10/1983 Fed. Rep. of Germany ..... 182/3

*Primary Examiner*—Sherman D. Basinger

*Attorney, Agent, or Firm*—Christensen, O'Connor, Johnson & Kindness

[57] ABSTRACT

A spreader bar for use in connection with a harness worn by a sailboarder. The spreader bar is fixedly interconnected with the harness and includes a sheave adapted to engage a line affixed at its ends to one arm of the wishbone boom of a sailboard. The spreader bar allows the user to support his weight on the boom line with the sheave adapted to roll on the line in response to movement of the board sailor or the boom. The sheave is supported so as to be easily engaged and disengaged from the boom line.

13 Claims, 2 Drawing Sheets

Fig. 1.
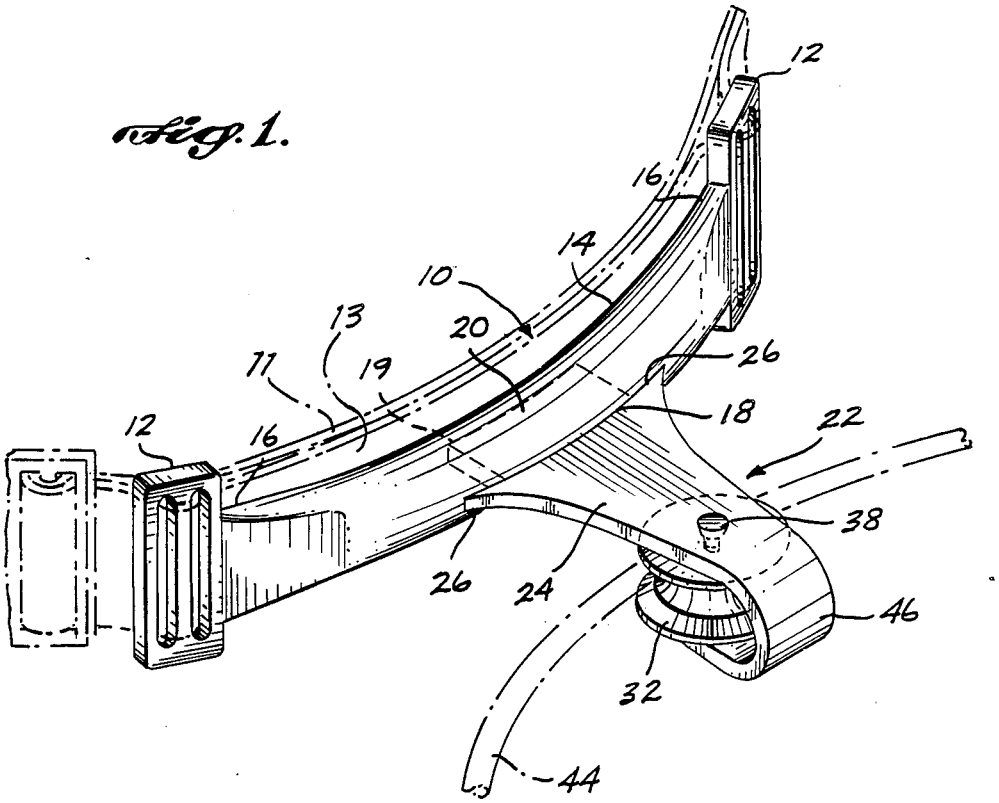
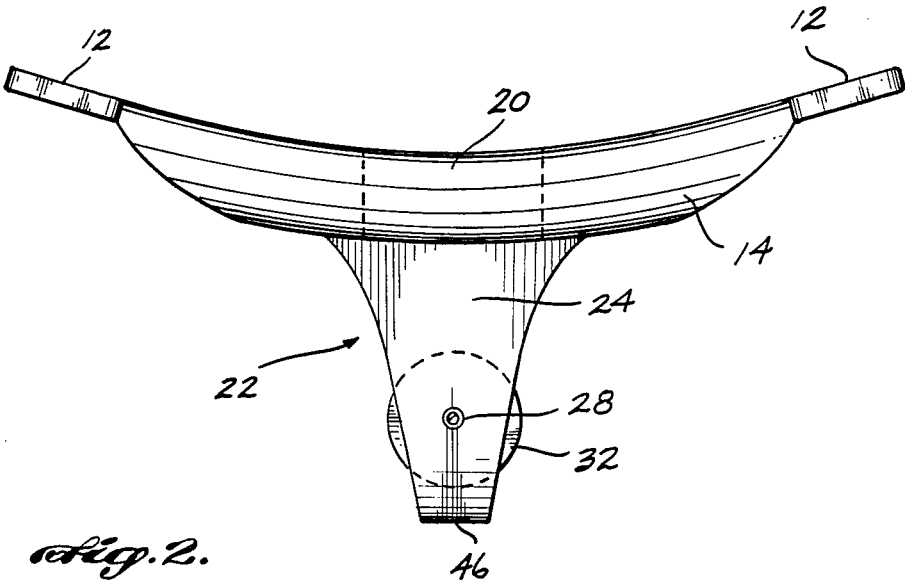
Fig. 2.

SAILBOARD HARNESS SPREADER BAR

BACKGROUND OF THE INVENTION

1. Field of the Invention

The present invention relates generally to a spreader bar for supporting the weight of a sailboard user on a line connected to the wishbone boom of a sailboard. More particularly, the invention relates to a spreader bar mountable on a harness worn by a sailboard user and including a rotatable sheave having an open entry for easy engagement or disengagement with the boom line, such that the sheave bar may move freely without friction along the boom line.

2. Description of the Prior Art

It has long been known that trapeze harnesses of the type generally used in the sport of sailing may also be used by sailboarders to facilitate gripping the wishbone boom of a sailboard. For use in sailboarding, a trapeze harness is provided with a means for interconnecting the harness with boom lines, i.e., lines tied at their ends at spaced points on the arms of the wishbone boom of a sailboard. Such interconnection means is commonly called a spreader bar since one of its functions is to comfortably spread the weight of the user supported on the boom line around the body of the user. U.S. Pat. No. 4,741,280 discloses a safety hook adapted to be interconnected with a harness that includes a wide contact area for the boom line to prevent winding of the line around the hook. A drawback for this simple hook design is that when the weight of a sailboarder is supported by the line through such a fixed hook, substantial friction arises between the hook and the line as the hook moves along the line. This friction not only causes the line to wear and break unexpectedly, but also reduces the sailboarders's ability to quickly and easily adjust sail trim in response to wind shifts, changes in board direction, or the like.

U.S. Pat. No. 4,630,563 discloses a trapeze belt or harness of a type including a boom line hook disposed on a carriage which is laterally displaceable on guide tracks. U.S. Pat. No. 4,458,617 discloses a board sailing harness including a roller interconnected directly with a sailboard boom rather than to a line tied to a boom such that the possibility of entanglement of the sailboarder with a boom line is removed.

None of the known prior art devices have simply and economically solved the problem of providing a sturdy spreader bar that may be easily engaged and disengaged from a line mounted on a sailboard boom while eliminating wear to the boom line and improving the ability of a sailboarder to adjust sail trim while supporting his weight on a boom line.

SUMMARY OF THE INVENTION

The present invention comprises a spreader bar adapted to releasably engage a line tied at its ends to one side of a wishbone boom of a sailboard including a rigid structure member interconnectible with a conventional trapeze harness, the rigid structural member having a sheave mounted thereon in front of the user adapted to roll on the boom line in response to movement of the user or the boom. The sheave is mounted such that the side of the sheave groove facing the user is open and, thus, accessible for engagement with the boom line such that the weight of the board sailor may be supported thereon through the sheave, the sheave support structure which spreads the weight load and the harness worn by the user.

BRIEF DESCRIPTION OF THE DRAWINGS

FIG. 1 is a perspective view of a spreader bar made according to the instant invention;

FIG. 2 is a top plan view of the spreader bar of FIG. 1;

DETAILED DESCRIPTION OF THE INVENTION

Figure 3:
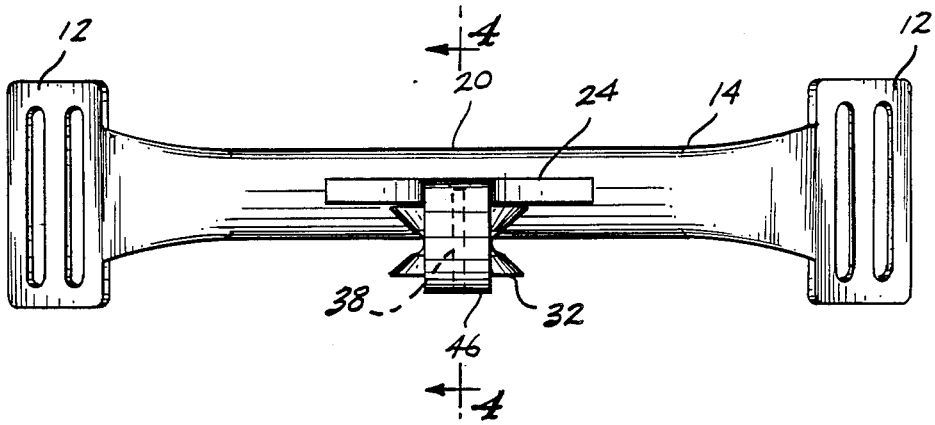
FIG. 3 is a front elevation of the spreader bar of FIG. 1.

Referring initially to FIG. 1, a spreader bar 10 is disclosed of a type that is compatible for use with a conventional chest, waist or seat harness 11, shown in phantom, used by sailboarders or small boat sailors. Such harnesses are commonly referred to as "trapeze" harnesses and are typically worn on the torso of a user such that the weight of the user may be supported on a line connected to the boom of the sailboard or the mast of a sailboat. Spreader bar 10 functions to interconnect the trapeze harness to such a line so that the weight of the user is spread laterally to avoid compressing the user's thorax as would be the case if the harness were connected to the load support line at a single point. The pair of spaced apart connectors 12, which are mounted on the ends of the laterally extending bar 14, direct the user's weight load around the sides and back of the user's body rather than at a diverging angle across the front of the body. As illustrated, connectors 12 each comprise a pair of vertical slots through which a belt 13 of the harness 11 may be threaded. It has been found that this type of arrangement is readily usable in connection with a wide variety of harnesses but it should be understood that other forms of connector may be substituted for connectors 12 and still be deemed to be within the scope of the present invention.

In a preferred form, bar 14 is formed of a lightweight tubular metal such as anodized aluminum. Using anodized aluminum has the additional advantage of allowing the metal to be colored to match a harness, bathing suit, sailboard or the like. The ends 16 of tubular bar 14 are shown tapered to an end cross-sectional area adapted to mate with a lateral side of connector 12. These pieces are interconnected by conventional means such as welding.

Figure 4:
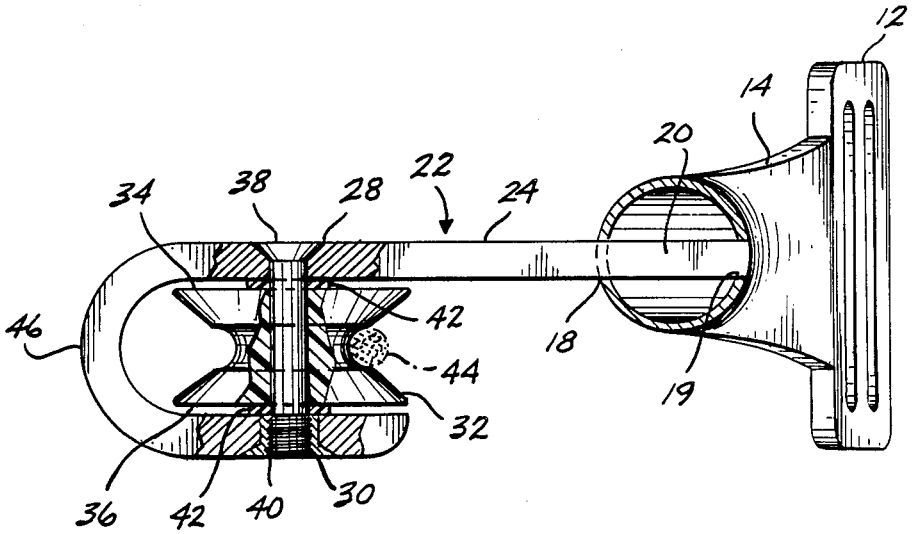
FIG. 4 is a section view taken along lines 4—4 in FIG. 3.

Bar 14 is also curved along its length to generally conform with the body configuration of the harness wearer. Bar 14 includes rectangular openings 18 and 19 on the forward and rearward surfaces of its central portion. As is best seen in FIG. 4, tab 20 of sheave support means 22 is inserted within openings 18 and 19 and welded therein to form a rigid fixed connection between forwardly extending shank 24 and hollow, laterally extending bar 14. As illustrated, shank 24 of the sheave support means 22 is wider than opening 18 and the interconnection between shank 24 and bar 14 is strengthened by welding flanges 26 of shank 24 to the front surface of bar 14.

Referring again to FIG. 4, sheave support means 22 is shown to be "J" shaped and includes an opening 28 in its top surface and an aligned opening 30 in the hook portion of the "J" positioned therebelow. A conventional grooved sheave 32 includes a central axial opening extending between its lateral sides 34 and 36. Sheave 32 is mounted on sheave support means 22 by means of a pin 38 which is inserted in axially aligned openings 28 and 30 and held therein by any conventional means. As illustrated, pin 38 is shown to be a threaded, flat headed screw that is adapted to be received by cooperating threads 40 in lower opening 30.

Compressible bearing-spacers such as Teflon washers 42, or the like, are positioned above and below the lateral sides 34 and 36 of sheave 32 to center the sheave between the opposed surfaces of sheave support means 22. It will be understood that the tighter fastener 38 is screwed into threads 40, the greater will be the squeezing force upon the opposed lateral sides 34 and 36 of sheave 32 thus making it more difficult for sheave 32 to rotate about pin 38. While it is normally desired to allow sheave 32 to rotate freely about pin 38, it will be understood that sailboarders may wish to control the rotatability of sheave 32 to slow its movement along a boom line to give them a better "feel" for the movement and trim of the sail.

Sheave support means 22 is shaped such that the portion of the groove of sheave 32 facing rearwardly toward the user is open to receive a boom line 44, shown in dotted line in FIGS. 1 and 4. Thus, when a user is riding a sailboard with his hands gripping one side of the wishbone boom in front of his chest, the spreader bar may be readily attached to boom line 44 by simply moving his torso such that the sheave support means 22 is placed over the boom line and then lowering the spreader bar, such as by bending at the knees or leaning backward, to cause the sheave groove to capture line 44. Similarly, the spreader bar can be disconnected from line 44 by simply reversing this movement such that line 44 freely drops out of the groove of sheave 32. When line 44 is captured within the groove of sheave 32, a substantial portion of the weight of the sailboarder may be supported on line 44 as the user leans backward away from the sailboard boom to counterbalance wind forces on the sail or to simply assume a comfortable resting position. Supporting the user's weight on line 44 removes a substantial load from the user's arms, thus reducing fatigue. As the sailboarder sails through the water supporting his weight on boom line 44, changes in the strength or orientation of the wind, or the board's meeting waves or currents, causes the boom and its interconnected boom line 44 to move with respect to the sailboarder, or the sailboarder to move with respect to the boom line. In either case, sheave 32 is adapted to rotate near-frictionlessly along line 44. The rotation of sheave 32 along line 44 prevents any substantial wear of line 44, thus eliminating the possibility of line 44 unexpectedly breaking, as commonly occurred with prior art hook devices.

In addition, the use of rotatable sheave 32 on boom line 44 allows the sailboarder to easily and quickly trim the sailboard's sail in response to wind shifts, or the like, without having to initially overcome a friction load between line 44 and a prior art nonrotatable hook. A sailor can thus quickly and easily adjust the position of the boom with his arms to maintain a course. Further, the chance of a sailboarder being thrown off balance by a friction load generated by a stationary hook connection to a boom line is also reduced. In this way the sailboarder can easily make the continuous adjustments required to maintain a sailboard sail in proper trim without having to continually overcome friction loads. The use of rotating sheave 32 has been found to make it much easier for a sailboarder to sail an accurate course and in general makes the maintenance of sail trim a much smoother and less fatiguing process.

Referring to FIG. 2, it will be noted that the width of sheave support means 22 is substantially equal to or greater than the width of sheave 32, particularly in the shank portion 24 between the sheave and lateral bar 14. It can also be seen that the sheave support means 22 is outwardly tapered from the end section 46 to where the sheave support means is connected to the lateral bar 14 and that the shank portion 24 has an outwardly curved taper adjacent the lateral bar. With this design, it is near impossible for boom line 44 to become looped around shank 24, and if such looping should occur, the boom line may be easily freed by simply sliding the looped line forward past sheave 32 and off the end portion 46 of the sheave support means 22.

Washers 42 are relatively thin such that the spaces between the lateral sides 34 and 36 of sheave 32 and the adjacent walls of the sheave support means are so small that it is not possible for line 44 to become wedged therebetween.

It is also contemplated that sheave support means 22 may be made of such a width that two or more rotatable sheaves may be mounted laterally thereon to spread the point of contact and the resultant load transmitted between boom line 44 and the rollers over a greater lateral distance. Such a design is considered to be within the scope of this invention. It will also be understood that the use of construction materials other than the earlier-mentioned anodized aluminum, including plastic, steel, stainless steel, graphite or boron, to form some or all of the parts of the present invention are also considered to be within the scope of the present invention. The selection of these materials depends upon a compromise between strength, weight, cost and other known factors. Likewise, the lateral support bar, harness supports and sheave support means may all be molded as a single unit if desired.

Although the present invention has been disclosed with respect to several preferred embodiments and modifications thereto, further modifications will be apparent to those skilled in the art. Accordingly, it is not intended that the invention be limited by the disclosure or by such modifications, but instead that its scope should be determined entirely by reference to the claims which follow hereinbelow.

The embodiments of the invention in which an exclusive property or privilege is claimed are defined as follows:

1. A spreader bar releasably engaging a line extending between connection points to the same side of a wishbone boom of a sailboard comprising:

lateral extending bar means, said bar means laterally spreading a load place thereon near its midpoint;

connector means mounted on each end of said bar means for connecting said bar means to a harness worn by a sailboard user;

a generally J-shaped sheave support means having a shank portion connected to approximately the midpoint of said bar means and extending outwardly therefrom, and a hook section integral with said shank portion having two spaced-apart parallel portions connected by an end portion extending therebetween; and a sheave means with a selected diameter rotatably mounted between said hook section parallel portions such that a section of said sheave means nearest said bar means is adapted to engage the line to allow a user to support his weight thereon, and a section of said sheave means distal said bar means is adjacent said sheave support means end portion.

2. The spreader bar of claim 1, wherein said sheave means includes a central axial opening and said sheave support means includes a pin means extending between said hook section spaced-apart parallel portions and through said sheave opening to rotatably mount said sheave thereon.

3. The spreader bar of claim 2, including means for adjusting the freedom of rotatability of said sheave means.

4. The spreader bar of claim 1, including means for adjusting the freedom of rotatability of said sheave means.

5. The spreader bar of claim 1, wherein said bar means is hollow, formed of metal and includes an opening at its midportion, the end of said shank portion being fixedly mounted in said opening.

6. The spreader bar of claim 1, wherein said hook section parallel portions have widths at least substantially equal to the diameter of said sheave, said sheave support means is outwardly tapered from said end portion to said bar means, and said shank portion is wider than said sheave diameter.

7. The spreader bar of claim 6, wherein said shank portion has an outwardly curved taper adjacent said bar means.

8. A spreader bar adapted to releasably engage a line extending between connection points to the same side of a wishbone boom of a sailboard comprising:

laterally extending hollow bar means formed of metal and including an opening formed at the midportion thereof;

connector means mounted on each end of said bar means for connecting said bar means to a harness worn by a sailboard user;

sheave support means comprising a shank portion fixedly mounted into said bar means opening and extending outwardly therefrom, a first portion integral with said shank distal from said bar means, a second portion parallel and spaced apart from said first portion, and an intermediate portion extending between said first and second portions; and sheave means having a pair of lateral sides and a central axial opening, said sheave mounted between said sheave support means first and second portions by a pin means extending through said sheave central axial opening between said sheave support means first and second portions so that said sheave means is rotatably mounted thereto such that a portion of a groove of said sheave means nearest said bar means engages the line to allow a user to support his weight thereon while sailboarding.

9. The spreader bar of claim 8, including means for adjusting the freedom of rotatability of said sheave means.

10. The spreader bar of claim 8, including a compressible spacer disposed between each lateral side of said sheave means and said sheave support means portion adjacent thereto.

11. The spreader bar of claim 8, wherein said sheave support means first and second portions have widths at least substantially equal to widths of said sheave means lateral sides, said sheave support means is outwardly tapered from said intermediate portion to said bar means, and said shank portion is wider than said sheave means lateral width.

12. The spreader bar of claim 11, wherein said shank portion has an outwardly curved taper adjacent said bar means.

13. The spreader bar of claim 12, including means for adjusting the freedom of rotatability of said sheave means.

* * * * *